US005267548A

United States Patent [19]

Rosenzopf et al.

[11] Patent Number: 5,267,548

[45] Date of Patent: Dec. 7, 1993

[54] STEREO LAMBDA CONTROL

[75] Inventors: Günter Rosenzopf, Ludwigsburg; Ulrich Steinbrenner, Stuttgart; Ernst Wild, Oberriexingen; Gerhard Schneider, Ditzingen, all of Fed. Rep. of Germany

[73] Assignee: Robert Bosch GmbH, Stuttgart

[21] Appl. No.: 646,607

[22] PCT Filed: Jul. 22, 1989

[86] PCT No.: PCT/DE89/00486

§ 371 Date: Feb. 4, 1991

§ 102(e) Date: Feb. 4, 1991

[30] Foreign Application Priority Data

Aug. 4, 1988 [DE] Fed. Rep. of Germany ..... 3826527

[51] Int. Cl.[5] ..... F02D 41/14

[52] U.S. Cl. ..... 123/692; 123/698

[58] Field of Search ..... 123/520, 691, 692, 698

[56] References Cited

U.S. PATENT DOCUMENTS 4,127,088 11/1978 Ezoe ..... 123/688
4,383,515 5/1983 Higashiyama et al. ..... 123/692
4,683,861 8/1987 Breitkreuz et al. ..... 123/698
4,831,992 5/1989 Jundt et al. ..... 123/698 X
5,072,712 12/1991 Steinbrenner et al. ..... 123/698 X

FOREIGN PATENT DOCUMENTS 2064171 6/1981 United Kingdom .

*Primary Examiner*—Tony M. Argenbright
*Attorney, Agent, or Firm*—Walter Ottesen

[57] ABSTRACT

In the method for the adapted precontrol and feedback control of the air/fuel mixtures to be supplied to the two fuel-metering devices of an internal combustion engine, which has two separate exhaust-gas channels with a lambda probe and a catalytic converter in each channel, a common value of the precontrol manipulated variable and a common lambda desired value are determined for both fuel-metering devices. On the other hand, values of a control manipulated variable are determined separately for each fuel-metering device and values of precontrol adaptation variables, which are dependent upon the values of the control manipulated value, are determined and are superposed separately one after the other on the common precontrol value. This method makes it possible to manage with a single device for both cylinder banks which are to be operated in a stereo lambda control.

3 Claims, 1 Drawing Sheet

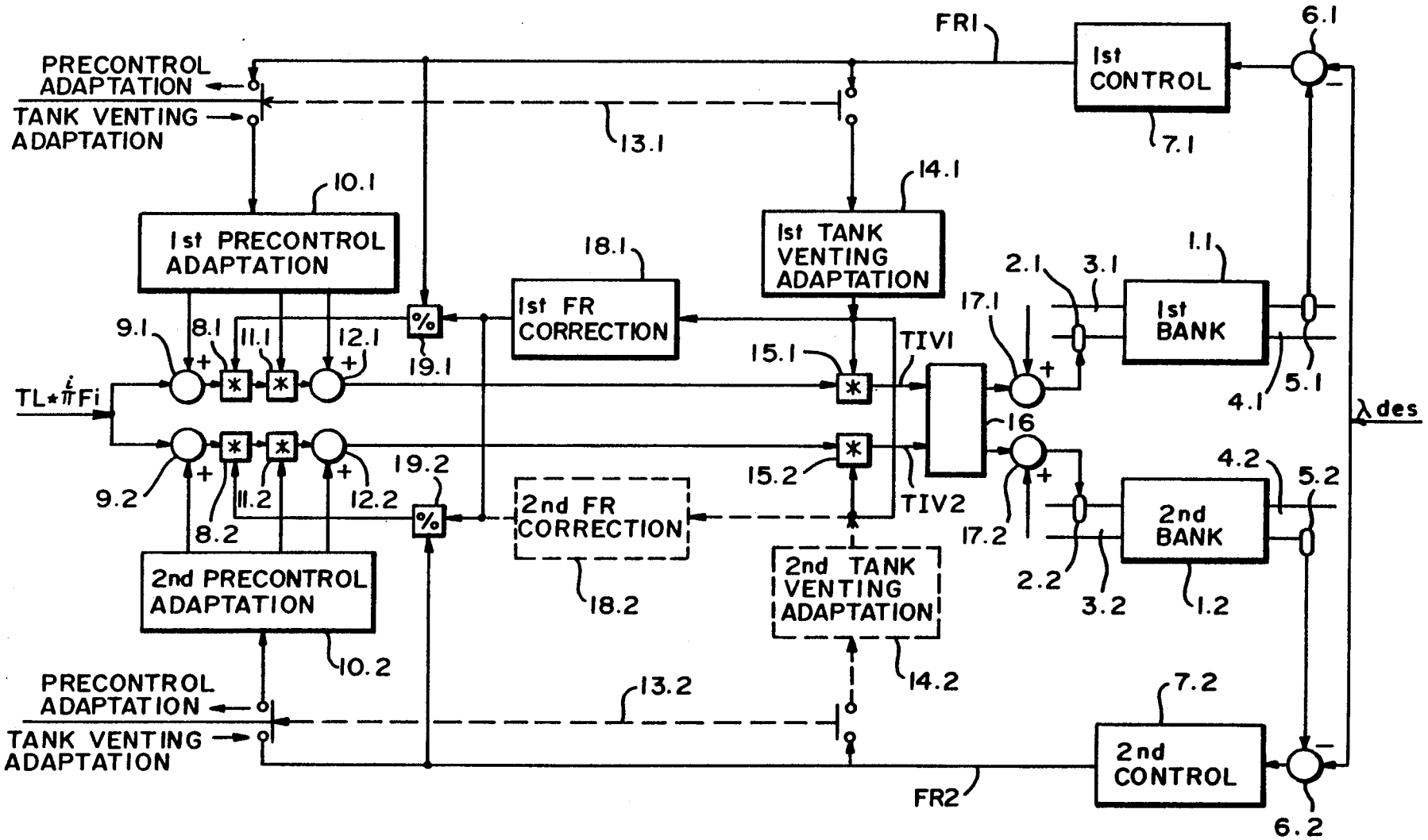
λdes
1st CONTROL
2nd CONTROL
1st BANK
2nd BANK
1st TANK VENTING ADAPTATION
2nd TANK VENTING ADAPTATION
1st FR CORRECTION
2nd FR CORRECTION
1st PRECONTROL ADAPTATION
2nd PRECONTROL ADAPTATION
PRECONTROL ADAPTATION
TANK VENTING ADAPTATION
TL*πFi
TIV1
TIV2
FR1
FR2

STEREO LAMBDA CONTROL

FIELD OF THE INVENTION

The invention relates to a method and an arrangement for the adapted precontrol and feedback control of the air/fuel mixtures to be supplied to the two fuel-metering devices of an internal combustion engine, which has two separate exhaust-gas channels with each channel having a lambda probe and a catalytic converter.

BACKGROUND OF THE INVENTION

Such a method and an apparatus for carrying out the method are known, for example, from a system by the applicant for the precontrol and feedback control of a 12-cylinder spark-ignition engine which has two cylinder banks with each bank having six cylinders. The fuel-metering devices are designed as injection devices. The intake pipes are separated from each other, and there are two separate tank venting valves. The adapted precontrol and feedback control are carried out by two mutually separate individual apparatus, each apparatus being assigned to a respective cylinder bank.

A similar method as well as a corresponding arrangement is also disclosed in U.S. Pat. No. 4,383,515. However, here only one precontrol value dependent upon engine speed and load without adaptation is utilized and only the exhaust gases of the two cylinder banks having separate exhaust-gas probes are detected. Tank venting is not provided.

U.S. Pat. No. 4,683,861 discloses an arrangement for venting a fuel tank utilizing a lambda control as well as an adaptive precontrol. In this connection, the basic adaptation in the lambda control loop for the computation of the metered fuel is only then released when the quantities of fuel originating from tank venting are negligible.

Methods of the type mentioned at the beginning are referred to as stereo lambda control. The separate exhaust-gas channels with a lambda probe and a catalytic converter in each channel are characteristic of stereo lambda control. The exhaust pipes may be united downstream of the catalytic converter. The intake lines need not be completely separate from each other, as in the case of the exemplary application described, instead air may be taken in jointly for both banks through a main pipe.

Adapted precontrol and feedback control is understood as being the process by which precontrol values for setting the air/fuel mixture, as a rule preliminary injection times, are determined in dependence upon values of operating variables. The precontrol values are chosen such that a desired lambda value is to be specifically achieved in the particular operating state, especially the lambda value 1, in the case of lean concepts a lambda value greater than 1. If deviations from the desired lambda value occur, they are corrected. In order to allow for system-immanent disturbance quantities, an adaptation is also carried out, that is the precontrol values are corrected with integral results of the value of the feedback control manipulated variable. As a result, system deviations remain within narrow limits, which results in fast correction and a low tendency to oscillate of the arrangement for adapted precontrol and feedback control.

In the case of a stereo lambda control, individual disturbances, for example different air leakage rates and different through-flow rates of the fuel-metering devices, act on each of the two cylinder banks. According to the state of the art, allowance is made for this independence of the two cylinder banks from each other by the method for adapted precontrol and feedback control being carried out separately for each bank, in an apparatus provided separately for this in each case. This leads to a relatively high cost of the overall apparatus for stereo lambda control.

SUMMARY OF THE INVENTION

The invention is based on the object of providing a method for stereo lambda control which manages with a single apparatus for the adapted precontrol and feedback control of the two fuel-metering devices for two cylinder banks of an internal combustion engine. The invention is also based on the object of providing an apparatus for stereo lambda control which operates according to such a method.

The method of the invention is for the adapted precontrol and feedback control of the air/fuel mixtures to be supplied to the two fuel-metering devices of an internal combustion engine, which has two separate exhaust-gas channels with a lambda probe and a catalytic converter in each channel. The method provides that a common load signal is detected for both fuel-metering devices; a value of the precontrol manipulated variable common to both fuel-metering devices and a common lambda desired value are determined; and, values of a feedback control manipulated variable and values of precontrol manipulated variables, which are dependent upon the values of the feedback control manipulated variable, and values of precontrol adaptation variables which are dependent upon the values of the precontrol manipulated variables, are determined separately for each fuel-metering device and are superposed separately on the common value of the precontrol manipulated variable.

According to another feature of the method of the invention, a common tank-venting adaptation value is used for both fuel-metering devices, which value is determined from the control manipulated variable determined for one of the two fuel-metering devices.

According to still another feature of the method of the invention, if the determination of the tank-venting adaptation value for the first fuel-metering device is no longer possible because of a defect, when this value is determined from the control manipulated variable formed for the second fuel-metering device, and used in common for both fuel-metering devices.

The apparatus of the invention is for the adapted precontrol and feedback control of the air/fuel mixtures to be supplied to the two fuel-metering device of an internal combustion engine, which has two separate exhaust-gas channels with a lambda probe and a catalytic converter in each channel. The apparatus includes a means for detecting a common load signal for both fuel-metering devices; a means for determining a common value of a precontrol manipulated variable for both fuel-metering devices and for determining a common lambda desired value; and, a means for separately determining values of a control manipulated variable and values of precontrol adaptation variables, which are dependent on the values of the control manipulated variable, and for alternately superposing these values on the value of the precontrol manipulated variable.

The method according to the invention is based essentially on two realizations. One realization is that the individual characteristics of the two cylinder banks of an internal combustion engine are all reflected in the two separately performed lambda value measurements, that is they can be taken into account by different values of the feedback control manipulated variable and different values of the precontrol adaptation variables calculated from the feedback control manipulated variable. The values of the precontrol manipulated variables are conventionally to be determined in complex computation processes from characteristic fields or characteristic curves. The processing time of a feedback control process can be shortened considerably with the method according to the invention, since the values of the precontrol manipulated variables are used jointly for both cylinder banks. The same applies correspondingly with respect to lambda desired values if a lean control is concerned. The second realization is that a particular value available for a precontrol manipulated variable cannot be modified continuously with correction values for the two banks but that the operating cycles of the cylinders in the two banks are offset with respect to each other, that is, in a first period the value of the precontrol manipulated variable has to be modified with correction values for one bank and thereafter with correction values for the other bank. In the case of the stereo lambda control method according to the invention, a joint precontrol value for the manipulated variables and a joint lambda desired value are thus determined for both fuel-metering devices, but values of a feedback control manipulated variable and values of precontrol adaptation variables dependent on the latter are determined separately for each fuel-metering device and superimposed separately one after the other onto the joint value of the precontrol manipulated variable. An apparatus according to the invention for stereo lambda control is accordingly distinguished by the fact that it is designed jointly for both cylinder banks and has means for executing the mentioned method steps.

According to a further development of the method, a joint tank venting adaptation value is used for both fuel-metering devices, which value is determined from the feedback control manipulated variable determined for one of the two fuel-metering devices. This is possible even if completely separate intake lines are used. This is based on the realization that the suction performance of the two cylinder banks (for example because of individual rates of air leakage) must be considered with the tank-venting adaptation. In the method of the invention, this takes place by the precontrol adaptive values determined separately for the two cylinder banks and which are used unchanged during the tank-venting adaptation.

BRIEF DESCRIPTION OF THE DRAWINGS

The invention is explained in more detail below with reference to embodiments illustrated by a figure. The figure shows an embodiment of a method according to the invention in the form of a function block diagram.

DESCRIPTION OF THE PREFERRED EMBODIMENTS OF THE INVENTION

Shown in the center of the right of the figure is a first cylinder bank 1.1 with, for example, four cylinders and a second cylinder bank 1.2, which has the same number of cylinders. The number of cylinders is not indicated any more specifically and is also not relevant hereafter. Injection valves are arranged in the intake stub 2.1 of the first bank 1.1 as fuel-metering device 3.1. Correspondingly, the second bank 1.2 has an intake stub 2.2 with a fuel-metering device 3.2. A first lambda probe 5.1 is provided in the exhaust pipe 4.1 of the first cylinder bank 1.1. A corresponding second lambda probe 5.2 is provided in the exhaust pipe 4.2 of the second cylinder bank 1.2.

Apart from the physical components just mentioned, FIG. 1 only represents functional steps such as they are performed by a program in a stereo lambda control arrangement. Individual functional steps can also be realized by separate components, which is only cost-effective however in cases of high numbers. According to the current state of the art, as a rule all functions of a lambda control are realized by a program running in a microcomputer.

In the following, first the subprocess is described as carried out for the first cylinder bank 1.1.

In a comparison step 6.1, the lambda actual value, determined by the first lambda probe 5.1, is subtracted from a lambda desired value. As a rule, the lambda desired value is 1, but can, in the case of lean concepts, also be greater than 1. In the latter case, the lambda desired value is determined in dependence on values of actual operating variables, for example the accelerator pedal position and the engine speed, from a characteristic field or by evaluation of characteristic curves. The difference value formed from the two lambda values is processed in a control step 7.1, identified in the figure by "1st control", for outputting a feedback control manipulated variable. In the case of the exemplary embodiment, the feedback control manipulated variable is a control factor FR1. With this control factor FR1, a value of a precontrol manipulated variable TL $\hat{x}$ $\pi$ Fi, which has already been additively modified with a leakage air adaptation value in a leakage air adaptation step 9.1, is multiplicatively modified in a feedback control multiplication step 8.1. This leakage air adaptation value was obtained in a precontrol adaptation step 10.1 by integration of the control factor FR1 in any known way. In the case of the exemplary embodiment shown, not only the leakage air adaptation value but also a multiplicative adaptation value and an additive adaptation value are determined in the precontrol adaptation step 10.1. The multiplicative adaptation value is combined multiplicatively in an adaptation multiplication step 11.1 with the value of the precontrol manipulated variable modified by the above-mentioned steps. Then, the additive adaptation value is added to it in an adaptation addition step 12.1. All adaptation values are constantly redetermined by integration of the control factor FR1 as long as a precontrol adaptation flag 13.1 is set. This flag is shown in the figure as a switch, which closes when displaced to the left. On the other hand, on resetting the flag, corresponding to a displacement of the switch to the right, tank-venting adaptation takes place. The flag is set and reset at predetermined regular intervals of, for example, a few seconds.

In a period in which tank-venting adaptation is taking place, a tank-venting adaptation value is determined in any known way in a tank-venting adaptation step 14.1, which value is multiplicatively combined in a tank-venting multiplication step 15.1 with the particular value available for the precontrol manipulated variable, modified by precontrol adaptation values. During those phases in which tank-venting adaptation takes place, the precontrol adaptation values thus remain unchanged, while in periods with precontrol adaptation the tank-venting adaptation value remains unchanged, that is, at the value 1. Values of the precontrol manipulated variables are thus modified in the precontrol adaptation period with a variable control factor FR1 and variable values of the precontrol manipulated variables, while the precontrol values continue to be modified during the tank-venting adaptation period by the continuously changing control factor FR1 and the tank-venting adaptation value. The result is a preliminary injection time TIV1.

The preliminary injection time TIV1 is passed on via an interface 16 into a second computer, which is likewise shared by both cylinder banks 1.1 and 1.2 and, in a correction adding stage 17.1, additively introduces a correction time which takes into account disturbances with respect to battery-voltage dependent characteristics of the injection valves of the fuel-metering device 3.1. In addition, crankshaft-dependent opening and closing time points are determined for each injection valve, which is not shown separately.

In the exemplary embodiment, the interface 16 between two computers is provided because the usual computers according to the current state of the technology for determining adapted manipulated variables do not have sufficient outputs to activate sequentially and separately a plurality of injection valves. Thus, on the left of the interface 16 there is a main computer and on the right, there is an auxiliary computer for the outputting of activation variables for the injection valves. In a modification of the exemplary embodiment, the auxiliary computer can perform not only the final modifying step of the values of the precontrol manipulated variables, namely the multiplying step 17.1 for battery voltage correction, but it can also take over other of the above-mentioned modifying steps. Then the corresponding modifying values, that is, for example, the tank-venting adaptation values, likewise have to be transferred via the interface 16. Conversely, it is possible also for the final modifying step 17.1 to be performed by the main computer.

All computing steps which have so far been described for the lambda control of the first cylinder bank 1.1 are correspondingly performed for the second cylinder bank 1.2. Corresponding computing steps are indicated in the figure by ".2" instead of ".1" but otherwise have the same reference numerals.

Of significance for the method described is that lambda desired values and values of precontrol manipulated variables are used jointly and only the values of the manipulated variables FR1 and FR2 and the adaptation values calculated from these values are determined individually for the cylinder banks. The values of the precontrol manipulated variables are not modified jointly in each case for the first cylinder bank 1.1 and the second cylinder bank 1.2, instead a precontrol value is initially modified in a certain short period with values determined for the first cylinder bank 1.1 in order to supply an injection time for an injection valve on the first cylinder bank, and in a subsequent short period the precontrol value is modified with values for the second cylinder bank 1.2 in order to provide injection values for an injection valve there. Due to these measures, it is possible to manage with a single apparatus for the stereo lambda control of both cylinder banks 1.1 and 1.2. Even if this apparatus is subdivided into a main computer and an auxiliary computer, it is nevertheless a joint apparatus.

Further above it was pointed out briefly that all that was described in detail for the first cylinder bank 1.1 with respect to computing steps for determining injection times applies correspondingly to the second cylinder bank. However, with respect to a preferred embodiment, this does not apply to the tank-venting adaptation. Therefore, the computing steps belonging to the second cylinder bank 1.2 which are concerned with the tank-venting adaptation have been drawn in broken lines in the figure. These are the tank-venting adaptation step 14.2 and a control factor correction step 18.2. The purpose of the correction step is that if the tank-venting adaptation value is changed, the control factor FR2 should be changed oppositely in a division step 19.2, so that the product of (already otherwise modified) precontrol value, control factor and tank-adaptation value remains constant. A corresponding control factor correction step 18.1 also takes place for values for the first cylinder bank 1.1. The precontrol adaptation values must also be recorrected correspondingly, which is not shown however for the sake of clarity. All of these recorrections are usual computation steps.

Since, as mentioned, the tank-venting adaptation step 14.2 for the second cylinder bank is not performed in the case of the preferred exemplary embodiment, but a tank-venting adaptation value is required for this cylinder bank, that tank-venting adaptation value, which was calculated in the tank-venting adaptation step 14.1, is used in the tank-venting multiplication step 15.2. This is possible since essentially the same disturbances act during the tank-venting adaptation phase, the effects of which disturbances were adapted in the preceding precontrol adaptation phase and are accordingly taken into account in the precontrol adaptation values. Possible small residual errors are compensated by slightly different control factors FR1 and FR2 for the two cylinder banks 1.1 and 1.2, respectively. The control factor correction value is also taken over.

If the tank-venting adaptation value can no longer be determined for example from the control factor FR1, this is established by an error searching process, and the tank-venting adaptation step 14.1 is then blocked and the tank-venting adaptation step 14.2 performed instead. The adaptation value supplied by this step is not only used in the tank-venting multiplication step 15.2 but also in the tank-venting multiplication step 15.1.

We claim:

1. A method of adaptive precontrol and feedback control of the air/fuel mixtures by means of two fuel-metering devices of an engine having two separate exhaust-gas channels, each of the channels having a lambda probe and a catalyzer, the method comprising the steps of:

detecting a common load signal for the two fuel-metering devices;

determining a precontrol manipulated variable (TL * $\frac{1}{n}$ Fi) common to both of said fuel-metering devices and determining a common lambda desired value ($\lambda_{des}$);

separately determining first values of a lambda feedback control manipulated variable for each fuel-metering device;

separately determining second value of precontrol manipulated variables dependent upon said first values;

separately determining third values of precontrol adaptive variables dependent upon said second values;

separately superposing said first values, said second values and then said third values on the common precontrol manipulated variable (TL * $\overset{i}{\pi}$ Fi);

determining a common tank-venting adaptation value from feedback control factors (FR1, FR2) specified for one of the two fuel-metering devices;

using said common tank-venting adaptation value for both of said fuel-metering devices with the precontrol adaptation taking place separately from said tank-venting adaptation; and, then, when a tank-venting adaptation takes place, correcting a feedback control factor (FR1, FR2) in a manner which leaves the lambda corrected injection time (TIV) unchanged.

2. The method of claim 1, wherein: then, when the determination of the tank-venting adaptation value for the first fuel-metering device is no longer possible because of a defect, said tank-venting adaptation value is determined from the feedback control manipulated variable formed for the second fuel-metering device and is used for both fuel-metering devices in common.

3. An arrangement for adaptive precontrol and feedback control of the air/fuel mixtures by means of two fuel-metering devices of an internal combustion engine having two separate exhaust-gas channels, each of said channels having a lambda probe and a catalyzer, the arrangement comprising:

means for detecting a common load signal (TL) for both fuel-metering devices;

means for determining a common precontrol manipulated variable (TL * $\overset{i}{\pi}$ Fi) for both fuel-metering devices and for determining a common lambda value ($\lambda_{des}$);

means for separately determining first values of a lambda feedback control manipulated variable for each fuel-metering device and for separately determining second value of precontrol adaptation variables, dependent on said first values, and for separately determining third values of precontrol adaptation variables dependent on said second values, and for separately and superposing said first values, said second values and then said third values on said common precontrol manipulated variable (TL * $\overset{i}{\pi}$ Fi);

means for forming a common tank-venting adaptation value for both of said fuel-metering devices, said common tank-venting value being determined from said feedback control manipulated variable determined for one of the two fuel-metering devices;

means for ensuring that precontrol adaptation and tank-venting adaptation do not take place simultaneously; and, means for correcting a feedback control factor (FR1, FR2) in a manner which leaves the lambda corrected injection time (TIV) unchanged when a tank-venting adaptation takes place.

* * * * *